US009537275B2

(12) United States Patent
Ewing et al.

(10) Patent No.: US 9,537,275 B2
(45) Date of Patent: Jan. 3, 2017

(54) ELECTRIFIED BUS BAR AND BUS BAR SYSTEM FOR RETAIL MERCHANDISE DISPLAYS

(71) Applicants: Brent Ewing, Roscoe, IL (US); Ho Koon Man Peter, Tseung Kwan O (HK); Mike Bosco, Chicago, IL (US)

(72) Inventors: Brent Ewing, Roscoe, IL (US); Ho Koon Man Peter, Tseung Kwan O (HK); Mike Bosco, Chicago, IL (US)

(73) Assignee: Southern Imperial, Inc., Rockford, IL (US)

( * ) Notice: Subject to any disclaimer, the term of this patent is extended or adjusted under 35 U.S.C. 154(b) by 0 days.

(21) Appl. No.: 14/512,887

(22) Filed: Oct. 13, 2014

(65) Prior Publication Data

US 2016/0104985 A1 Apr. 14, 2016

(51) Int. Cl.

| | |
|---|---|
| ***H01R 25/14*** | (2006.01) |
| ***A47F 7/00*** | (2006.01) |
| ***F21V 33/00*** | (2006.01) |
| ***A47F 3/00*** | (2006.01) |

(52) U.S. Cl.

CPC ..... *H01R 25/147* (2013.01); *A47F 3/001* (2013.01); *A47F 7/00* (2013.01); *F21V 33/0012* (2013.01); *H01R 25/142* (2013.01)

(58) Field of Classification Search

CPC ..... F21V 33/0012; A47F 11/10; A47F 3/001; A47B 2220/0077; A47B 2220/0075

USPC ..... 362/133, 125, 92

See application file for complete search history.

(56) References Cited

U.S. PATENT DOCUMENTS

| | | | | |
|---|---|---|---|---|
| 4,747,025 | A * | 5/1988 | Barton | A47F 5/0846 211/94.01 |
| 9,004,427 | B2 * | 4/2015 | Irudayaraj | A47B 96/061 211/134 |
| 9,057,513 | B2 * | 6/2015 | Lindblom | F21V 21/34 |
| 9,098,823 | B2 * | 8/2015 | Slesinger | H01R 25/142 |
| 9,130,327 | B2 * | 9/2015 | Flynn | H01R 25/14 |
| 9,204,736 | B2 * | 12/2015 | Lindblom | A47F 3/001 |
| 2006/0207778 | A1 * | 9/2006 | Walter | A47B 96/14 174/19 |
| 2012/0230018 | A1 * | 9/2012 | Wiemer | A47F 5/103 362/133 |
| 2013/0299439 | A1 * | 11/2013 | Sid | A47F 5/0018 211/134 |

* cited by examiner

*Primary Examiner* — Brian Mattei
*Assistant Examiner* — Paola Agudelo
(74) *Attorney, Agent, or Firm* — Reinhart Boerner Van Deuren P.C.

(57) ABSTRACT

An electrified bus bar assembly is provided. The electrified bus bar assembly includes a track and one or more take-away adaptors that each are capable of acting as a power source to one or more display components. Each take away adaptor is mountable to the track via an electrical and mechanical connection.

17 Claims, 13 Drawing Sheets

FIG. 6
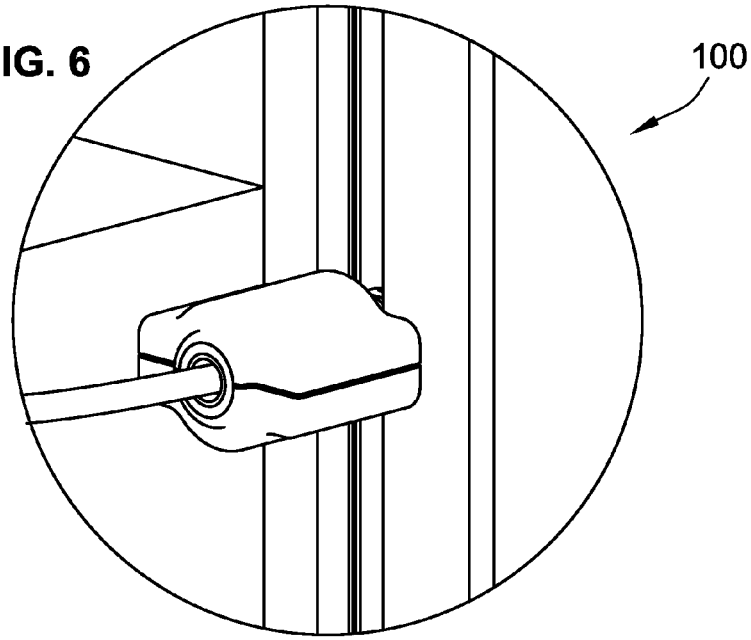
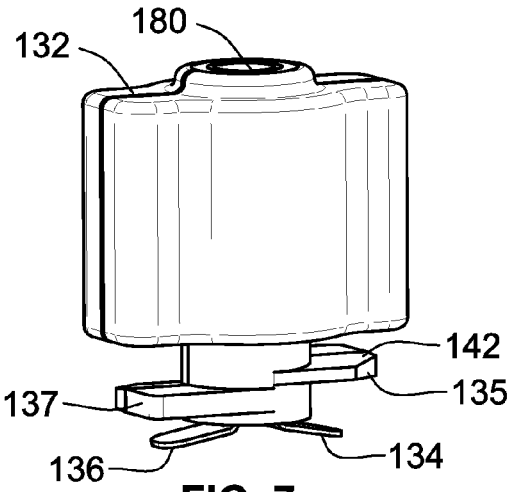
FIG. 7
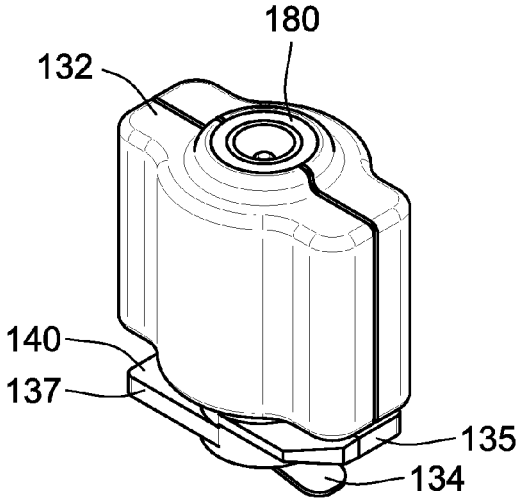
FIG. 8
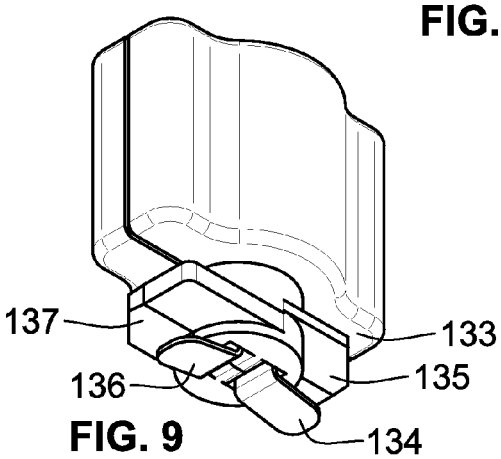
FIG. 9

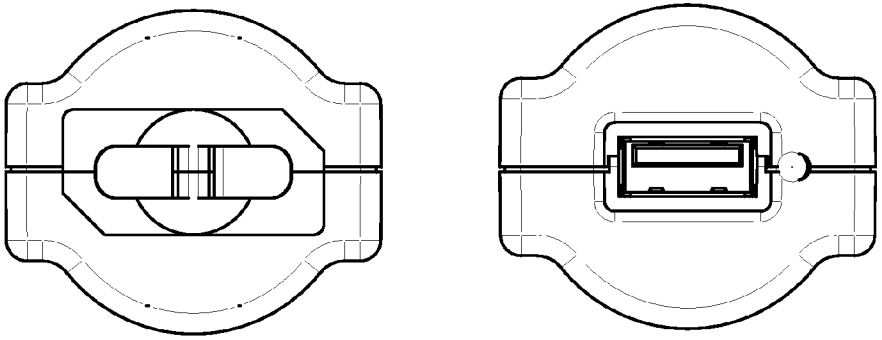
FIG. 25
FIG. 26
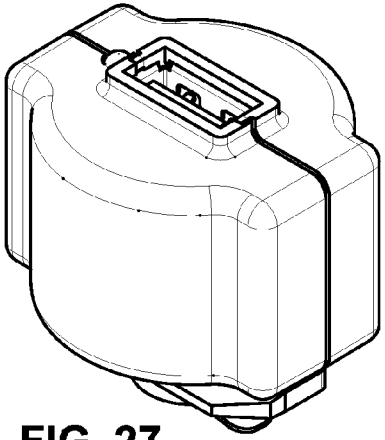
FIG. 27
FIG. 28
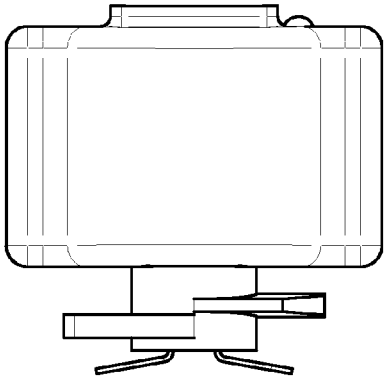
FIG. 29
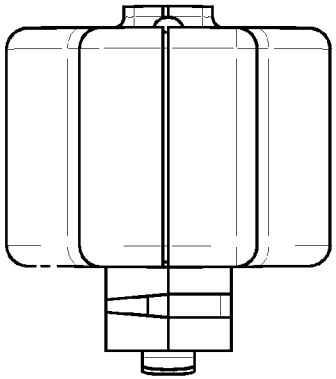
FIG. 30
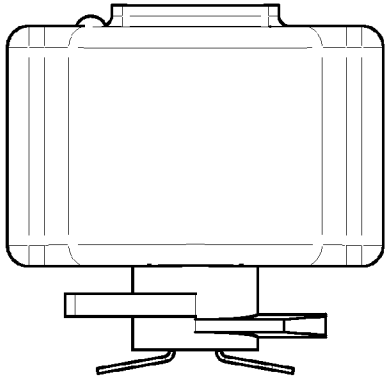
FIG. 31

ELECTRIFIED BUS BAR AND BUS BAR SYSTEM FOR RETAIL MERCHANDISE DISPLAYS

FIELD OF THE INVENTION

This invention generally relates to an electrified bus bar assembly and pertains more specifically to improved track, insulator construction, and take-away adaptors to power display elements.

BACKGROUND OF THE INVENTION

It is common to find electrified bus bar assemblies in retail settings because they are a convenient and reliable power source for lighting and electrical devices. Typical electrical bus bar assemblies have an insulator mounted within a housing and two electrified conductors mounted to the insulator. Track lighting and continuous plug-in busways are common examples of this type of track assembly. Take-away adaptors are typically used to tap power from the track or busway and provide a power source for the attached take-away devices. This type of bus bar can typically power any low voltage device from an LED light to a three phase machine. Thus, the appeal of a bus bar assembly is the ability to insert any number of take-away adaptors along the track to power any number of low voltage electrical devices.

Retailers typically use bus bar assemblies because it is cost prohibitive to install and maintain a typical three prong outlet for every electrical device in a retail setting. Conventional bus bar assemblies often found in retail settings are typically designed to mount to a displays shelving. A problem arises when a retailer occasionally or frequently decides to change the location of a display implementing a mounted bus bar assembly. The retailer must decide to un-mount the bus bar assembly from the display for relocation or to relocate the display with the bus bar assembly attached. In either scenario the retailer is disrupting a display, using man hours to un-mount and remount the bus bar assembly or to relocate the shelving with the bus bar assembly still mounted; all while running the risk of damaging the shelving and/or bus bar assembly during relocation.

Another problem faced by retailers using conventional bus bar assemblies is the electrical conductors or bus bars are often exposed to provide a contact point for the take-away adaptor. This increases the risk that an employee or patron will contact the exposed conductors and be exposed to hazardous electrical shock. Likewise, having the conductors exposed increases the risk of a low resistance connection being made between the conductors and shorting the circuit, which forces the retailers to incur the expense of repairing or replacing the bus bar assembly.

U.S. Pat. No. 4,747,025, hereinafter incorporated by reference in its entirety, illustrates the problems described above, which the current invention overcomes. In U.S. Pat. No. 4,747,025 a display panel is described that is formed from a single piece, in which parallel recesses are opened that allow electrical lighting means, powered by low voltage from a step-down transformer, to be mounted. The mechanical attachment and electrical supply of each flange is effected between two consecutive recesses of the panel, longitudinal electrical conductors being disposed externally, in the surface of the panel, along the edges of the recess. In such a system, the electrical conductors are directly accessible to be touched and the electrical devices powered by the assembly are mounted to the display shelving.

Therefore, the prior art fails to provide a bus bar assembly for a retail environment that is safe, reliable, inexpensive, robust, and simple to manufacture. The present invention provides such an electrified bus bar assembly. These and other advantages of the invention, as well as additional inventive features, will be apparent from the description of the invention provided herein.

BRIEF SUMMARY OF THE INVENTION

In one aspect, the invention provides an electrified bus bar assembly for bringing power and/or signal to electrically powered devices. An embodiment of a bus bar assembly according to this aspect includes an elongated track. The track has at least a first and a second groove to receive and retain a first and a second electrical conductor of the track. The first and second electrical conductors are configured for connecting to a power source. The bus bar assembly also includes at least one removable take-away adaptor capable of forming an electrical contact with the first and second electrical conductor to provide power and/or signal to a low voltage electrical device.

In certain embodiments, the track has a generally horizontal base adapted to be mounted or connected to any flat surface. The track may be composed of a thermoplastic. In certain embodiments, the track may be composed of VO rated Acrylonitrile butadiene styrene.

In certain embodiments, the track has a first and second J-shaped flange extending upwardly from the opposite ends of said horizontal base. The first and second J-shaped flanges have upwardly extending legs from which substantially horizontal arms extend inwardly towards each other in an opposed relation.

In certain embodiments, the take away-adaptor includes one or more electrically conductive contact elements that connect to the first and second electrical conductors to supply a power connection. The take-away adaptor further comprises at least one jack to supply one or more electrical power and/or signal connections to a display element. In certain embodiments, the jack is one of a USB port or an electrical DC port.

In certain embodiments, the take-away adaptor includes at least a first and second electrically conductive contact element and a first and second blade. The first and second electrically conductive contact element provide an electrically conductive contact with a mating surface of the first and second electrical conductors, and the first and second blades couple with first and second rails of the track in an installed position of the take-away adaptor.

The first blade has an upper most edge, and the second blade has an upper most edge. The upper most edge of the first blade being situated in a first horizontal plane, the upper most edge of the second blade being situated in a second horizontal plane parallel to and spaced apart from the first horizontal plane.

In certain embodiments, the track includes first and second rails configured for contact with the first and second blades of the take-away adaptor in an installed position of the take-away adaptor.

In another aspect, a retail display system is provided. An embodiment of such a system according to this aspect includes a retail merchandise display. An elongated track is mounted one of on or adjacent the retail merchandise display. The track is powered from a power source. The system also includes one or more a take-away adaptors that are configured to connect to the track by a mechanical connection and an electrical connection. The take away adaptor is configured to provide electrical power through the track to a display element.

In one embodiment, the track is mounted to the retail display system. In another embodiment, the track is aligned vertically along the merchandise display system. In another embodiment, the track is aligned horizontally along the retail display system.

In certain embodiments, the display element is an LED lighting system configured for the merchandise display system. In certain embodiments, there is more than one bus bar assembly having one or more take-away adaptors. The take away adaptor includes a first and second blade for mounting said take away adaptor to said track. The track is channel-shaped in cross-section and comprises a plurality of walls.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings:

FIG. 6 illustrates a close-up perspective view of the take-away adaptor coupled to the track;

FIGS. 7-9 illustrate various perspective views of the take-away adaptor;

FIGS. 18-31 are various views illustrating surface contours of embodiments of the take-away adaptor.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

In the following description of various example structures in accordance with the invention, reference is made to the accompanying drawings, which form a part hereof, and in which are shown by way of illustration of various structures in accordance with the invention. Additionally, it is to be understood that other specific arrangements of parts and structures may be utilized and structural and functional modifications may be made without departing from the scope of the present invention. Also, while the terms "top" and "bottom" and the like may be used in the specification to describe various example features and elements of the invention, these terms are used herein as a matter of convenience, e.g., based on the example orientations shown in the Figures and/or the orientations in typical use. Nothing in this specification should be construed as requiring a specific three dimensional or spatial orientation of structures in order to fall within the scope of this invention.

Figure 1:
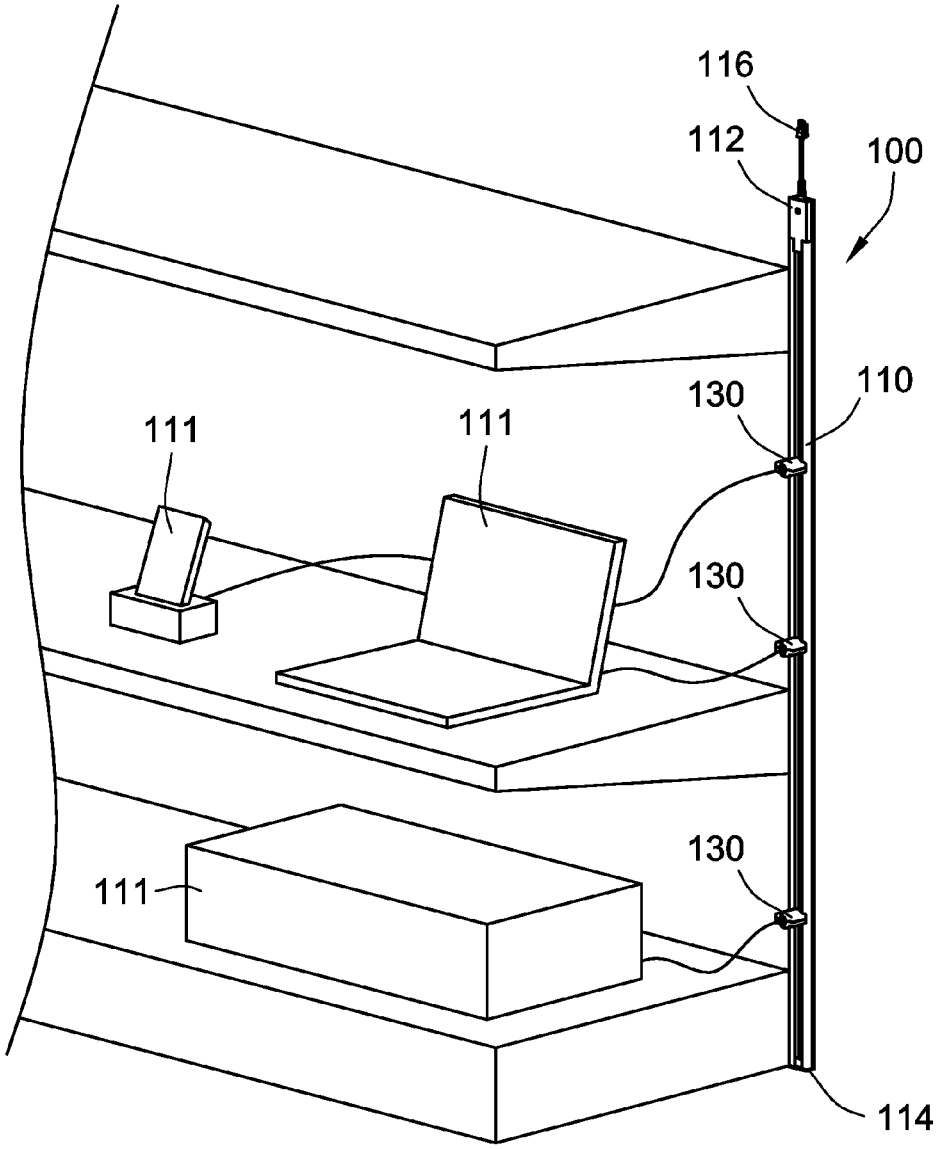
FIG. 1 illustrates a perspective view of one embodiment of an electrified bus bar and bus bar system that includes a bus bar assembly, shown in an exemplary retail environment.

As indicated, FIG. 1 illustrates an embodiment of an exemplary electrified bus bar assembly 100 in a retail environment. The embodiment of the bus bar assembly 100 illustrated in FIG. 1 comprises a channel shaped track 110, a take away adaptor 130 that is configured to form a mechanical and electrical connection with the track 110, and a display element 111. As will explained in greater detail below, the bus bar assembly 100 advantageously allows for the electrical connection of one or more of said display elements 111 in an electrically parallel arrangement.

As used herein, "display element" is meant to include any device requiring electrical signal transmission, e.g. power transmission, and may for example be personal computing devices, sensors, lights, and other devices. As one example, bus bar assembly 100 may provide electrical power to a plurality of laptop computers in a retailer's demonstration display. As another example, bus bar assembly 100 may provide electrical power to one or more sensors used to detect merchandise removal. As yet another example, bus bar assembly may provide electrical power to one or more lights of a retail display. As will be understood from the following, the bus bar assembly 100 overcomes existing problems in the art as discussed above.

Still referring to FIG. 1, track 110 is adapted to be mounted or supported in any orientation by any surface typically found in a retail environment. The track 110 is preferably made of material being a good electrical insulator and mechanically strong, such as VO rated flame retardant ABS, because the track 110 serves the dual purpose of offering mechanical support for a pair of electrical conductors 152,154 (see FIG. 5) and the take-away adaptor 130, while also acting as an electrical grounding connector for the display 111. In the exemplary configuration shown, the track 110 is mounted adjacent a plurality of retail shelves. Multiple take-away adaptors 130 are mounted to track 110, each of which is electrically coupled to a display element, which in the exemplary illustration are various electronic components.

Figure 2:
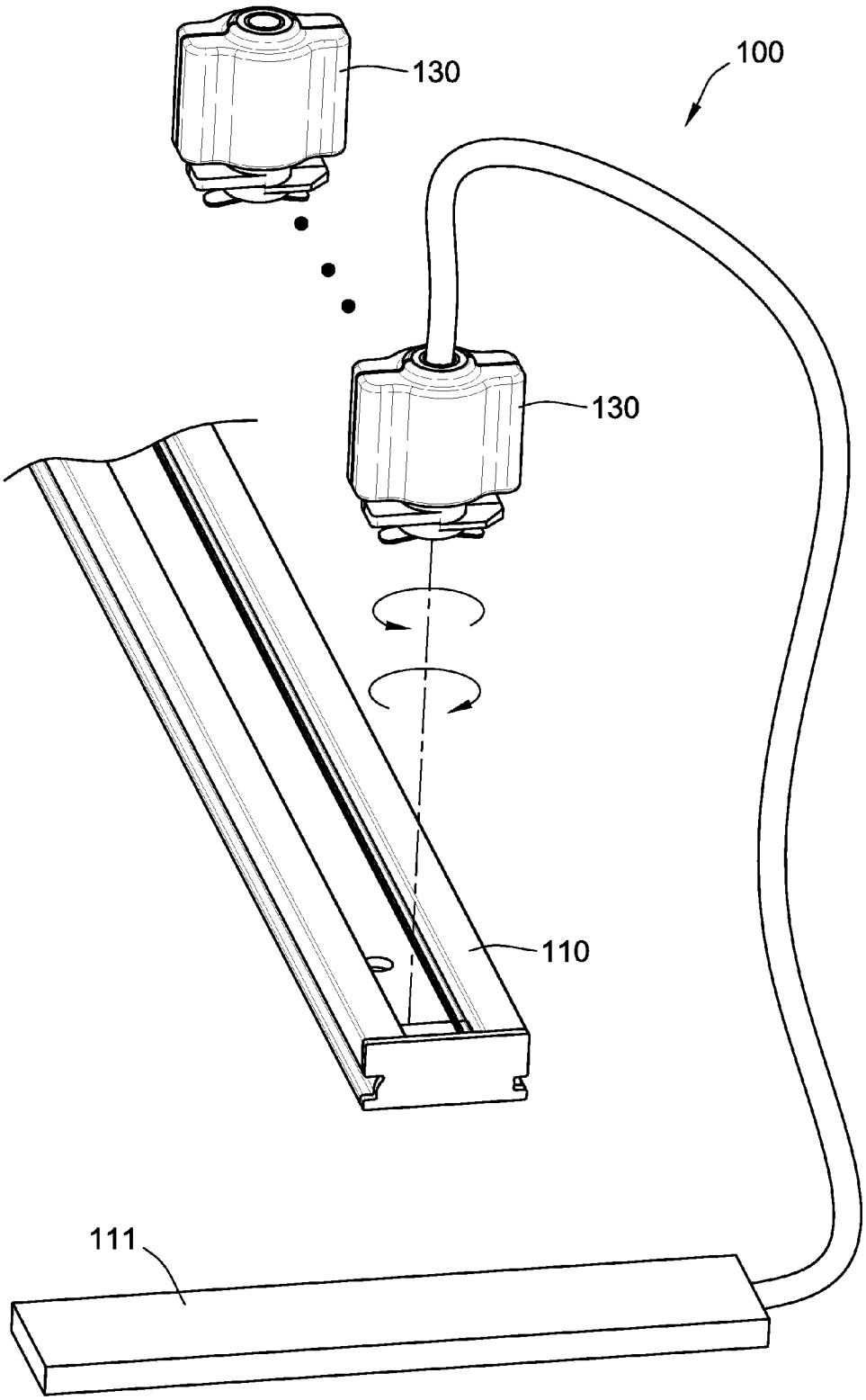
FIG. 2 illustrates a perspective assembly view of the bus bar assembly of FIG. 1, including a track, a take-away adaptor, and a retail display component connected to the take-away adaptor.

Turning now to FIG. 2, an exploded view of an exemplary configuration of the bus bar assembly 100 is illustrated. In this view, display element is in the form of a light used to provide lighting in a retail merchandise display. As will be explained in greater detail below, display element is removably connected to the take-away adaptor 130. Indeed, the take-away adaptor 130 includes a port on a top surface thereof, in the illustrated case a DC port, to which display element connects to. Also shown in FIG. 2 is a secondary take-away adaptor to which another display element 111 may connect to.

Still referring to FIG. 2, each take-away adaptor 130 defines a central axis about which the same is rotatable in first and second rotational directions as shown to mechanically and electrically connect and disconnect the take-away adaptor 130 to the track 110. The track 110, in turn, is electrically coupled to a power supply 88 (see FIG. 3) to provide electrical power to the entire system.

Figure 3:
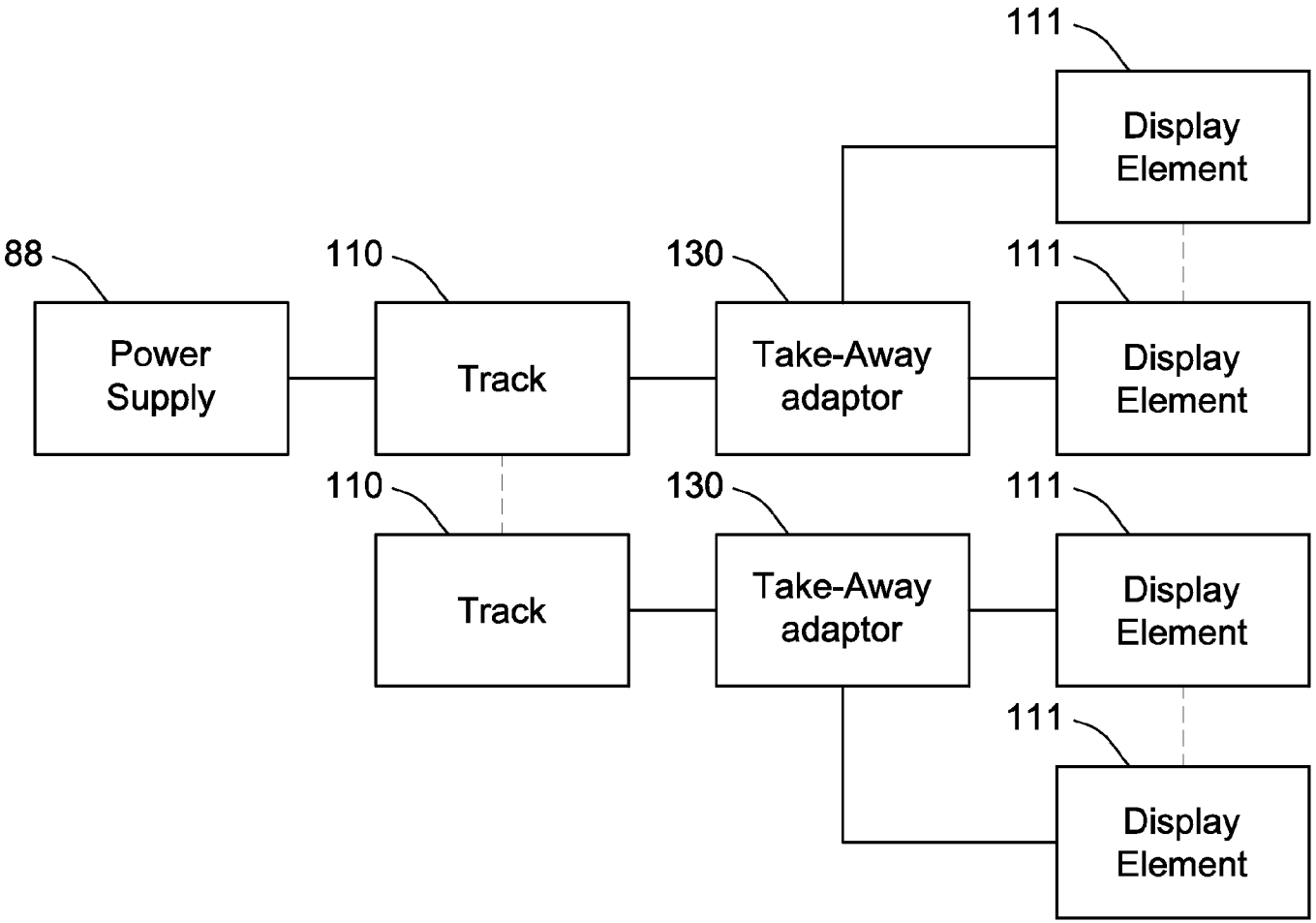
FIG. 3 illustrates an exemplary schematic of the system herein.

Turning now to FIG. 3, the above described configuration is schematically illustrated. A power supply 88 supplies electrical power to the track 110. A take-away adaptor 130 is connected to track 110. A display element 111 is electrically coupled to track 110. It is contemplated herein that more than a single display element 111 may connect to a single take-away adaptor 130. It is also contemplated herein that multiple display elements 111 may be connected in serial to one another, with a final one of the serially connected display elements 111 connected to take-away adaptor 130. It is also contemplated herein that multiple bus bar assemblies 110 may be serially connected to one another. In other words, a first track 110 may be coupled to a power supply 88, while a second track 110 may be coupled to the first track 110. Such a connection may be achieved by electrically coupling a take-away adaptor 130 coupled to the first track 110 to a take-away adaptor 130 coupled to the second track.

Figure 4:
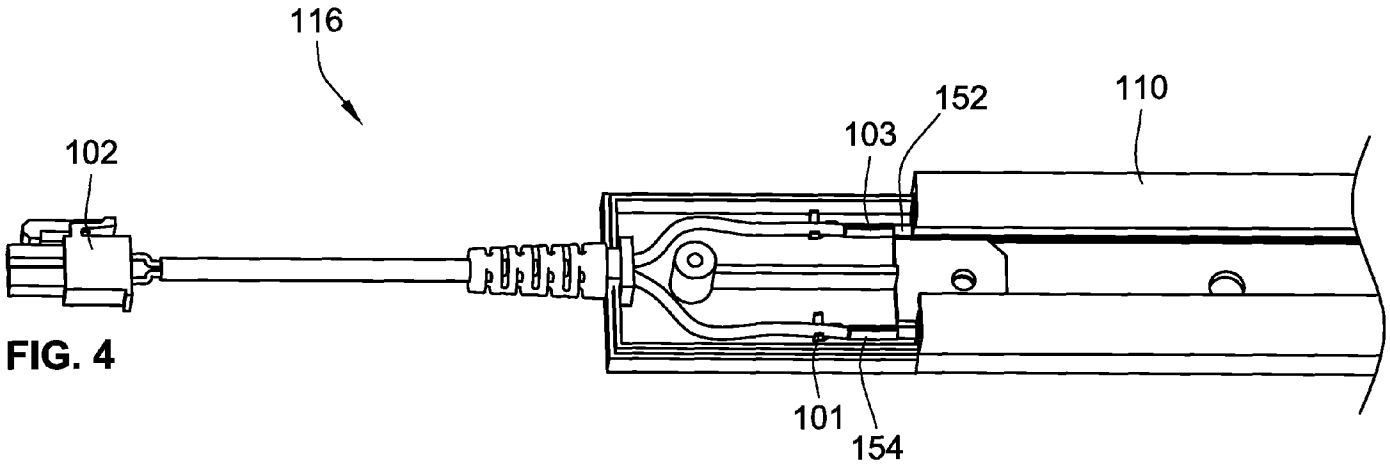
FIG. 4 illustrates a perspective view of an electrical termination arrangement of the track of the bus bar assembly.

Turning now to FIG. 4, track 110 includes an electrical termination arrangement 116 for connecting the track 110 to a power supply 88. In the illustrated embodiment, electrical termination arrangement 116 includes a male connector 102 for connection to the power supply 88. The power supply 88 may be a conventional AC to DC adaptor that itself is plugged into a retail establishment's power system. In other embodiments, electrical termination arrangement 116 include provisions therein which allow it to connect directly to a retail establishment's power system. Accordingly, the embodiment shown should be taken by way of example, not limitation.

Still referring to FIG. 4, a pair of first and second wires 101, 103, which terminate as the positive and negative contacts of the electrical termination arrangement 116 in the plug 102 are capable of forming an electrical contact with the first and second electrical conductors 152 and 154. This connection is formed within a housing of the electrical termination arrangement 116 at an end of the track 110. The conductors 152, 154, run the length of track 110 and thus form the positive and negative contacts of the track 110 to which each take-away adaptor 130 may connect to.

Figure 5:
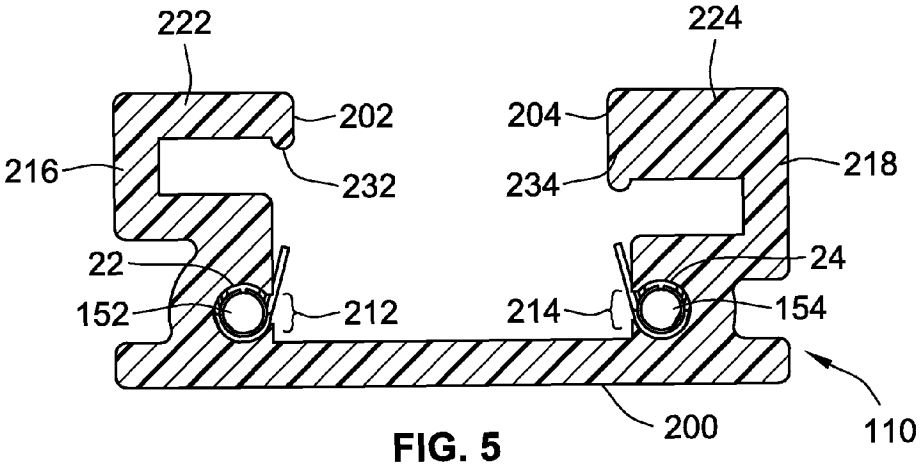
FIG. 5 illustrates a cross section of the track.

As best illustrated in FIG. 5 the track 110 has a generally horizontal base member 200 adapted to be mounted or connected to any flat surface in a retail environment. In a preferred embodiment the bus bar assembly 100 is mounted by an easily removable adhesive means, which allows for a quick and easy removal of the assembly, but may be mounted by any means known in the art including but not limited to a mechanical and magnetic means.

Still referring to FIG. 5, the track is a channel-shaped extruded. The track affords support for the take-away device (s) 130 as discussed herein. The track 110 is provided with first and second generally J-shaped flanges 202 and 204, extending upwardly from the opposite ends of the horizontal wall 200. The illustrated J-shaped flanges 202 and 204 have upwardly extending legs 216 and 218 from which first and second substantially horizontal arms 222 and 224 respectively extend inwardly towards each other in an opposed relation. Rails 232 and 234 project downwardly from the inner end of the respective arms 222 and 224, to afford support for the take-away adaptor 130 when coupled with the track 110. As shown, the first rail 232 is located higher than the second rail 234, for cooperating with corresponding first and second rider means 135 and 137 to insure the adaptor 130 is connected to the track 110 with the correct electrical polarity.

As shown in FIG. 5, the track 110 provides a first and second groove 22, 24 for receiving and retaining the corresponding first and second electrical conductors 152, 154, which are capable of providing an electrical power supply down the length of the track to be tapped by take-away adaptors 130. As will be explained in greater detail below, the track 110, due in part to the features described above, allows for each take-away adaptor 130 to be locked in place to the track 110 by a twisting motion. This locking in place is particularly advantageous in vertically mounted arrangements such as that shown in FIG. 6.

Figure 10:
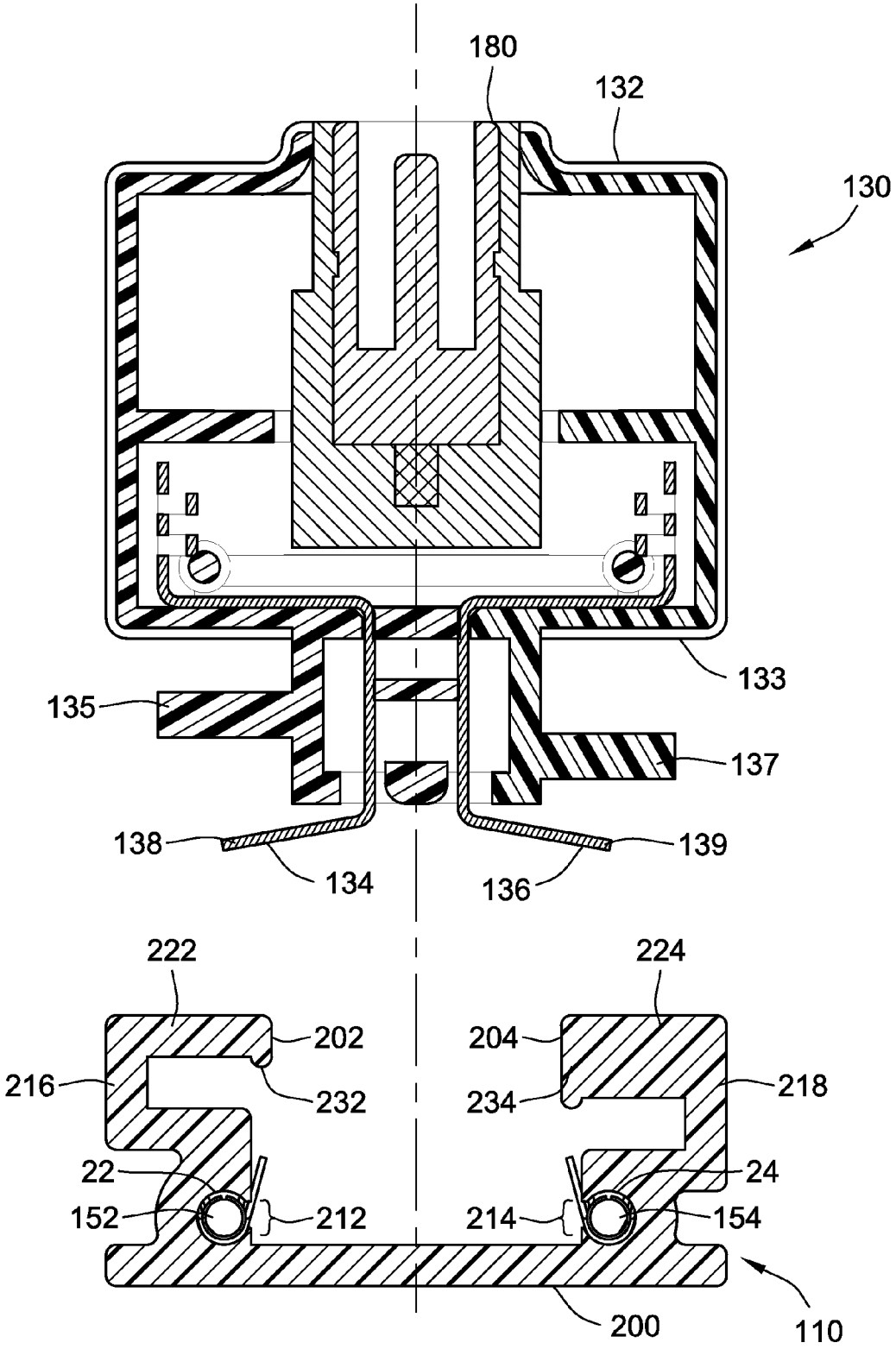
FIG. 10 illustrates a cross-sectional assembly view of the take-away adaptor relative to track.

FIGS. 7-9 illustrate the take-away adaptor 130. As best illustrated in FIG. 8 the take-away adaptor 130 has a jack 180 capable of supplying power and/or a signal to a display element 111 (see FIG. 2) such as an electronic device. In the embodiment of FIG. 8 the jack is represented by a 3 v DC adaptor, which is commonly used to power low voltage electrical devices. Although the embodiment in FIG. 8 illustrates a 3 v DC jack any type or form of power and/or signal jack may be adopted into the take-away adaptor 130. T Turning to FIG. 10 the take-away adaptor 130 has a first stab 134 and a second stab 136 which have corresponding first and second terminal surface 138 and 139. When an electrical contact is formed between terminal surfaces 138 and 139 and the corresponding conductors 152 and 154 the take-away adaptor 130 can provide power and/or a signal to a electrical device capable of coupling to the jack 180.

Additionally, the take-away adaptor 130 will have a first and second blade 135 and 137. A top most edge of the first blade 135 is positioned in a higher horizontal plane than a horizontal plane in which a top most edge of the second blade 137 is positioned in. As best illustrated in FIG. 10-13 the first and second blades 135,137 cooperate with the rails 232 and 234 to ensure that the take-away adaptor 130 is inserted into the track having the correct mechanical and electrical polarity.

Figure 11:
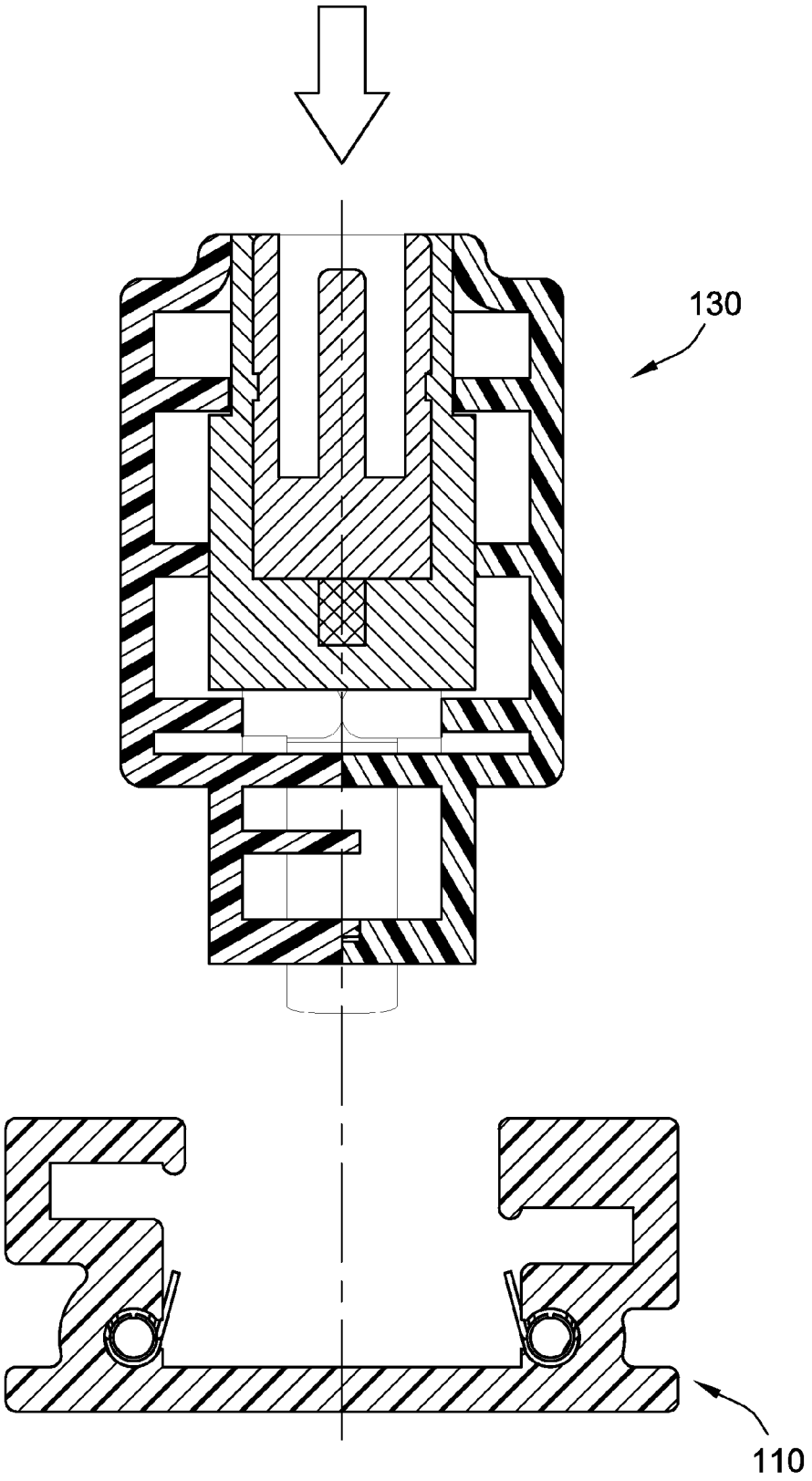
FIG. 11 illustrates a cross-sectional view of the take-away adaptor uncoupled from the track.
Figure 12:
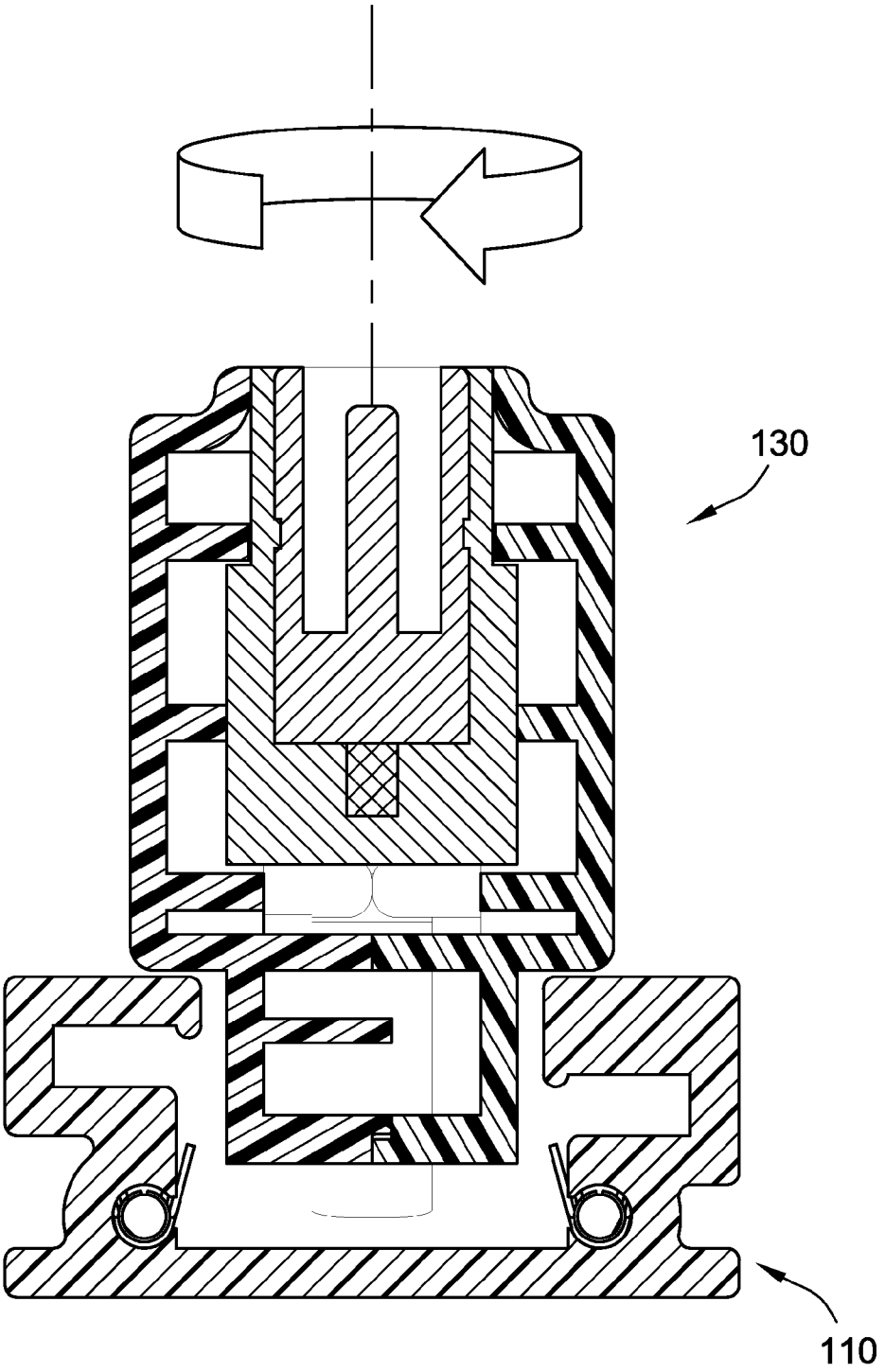
FIG. 12 illustrates a cross-sectional side-view of the take-away adaptor being inserted into the track and rotated above its center axis.
Figure 13:
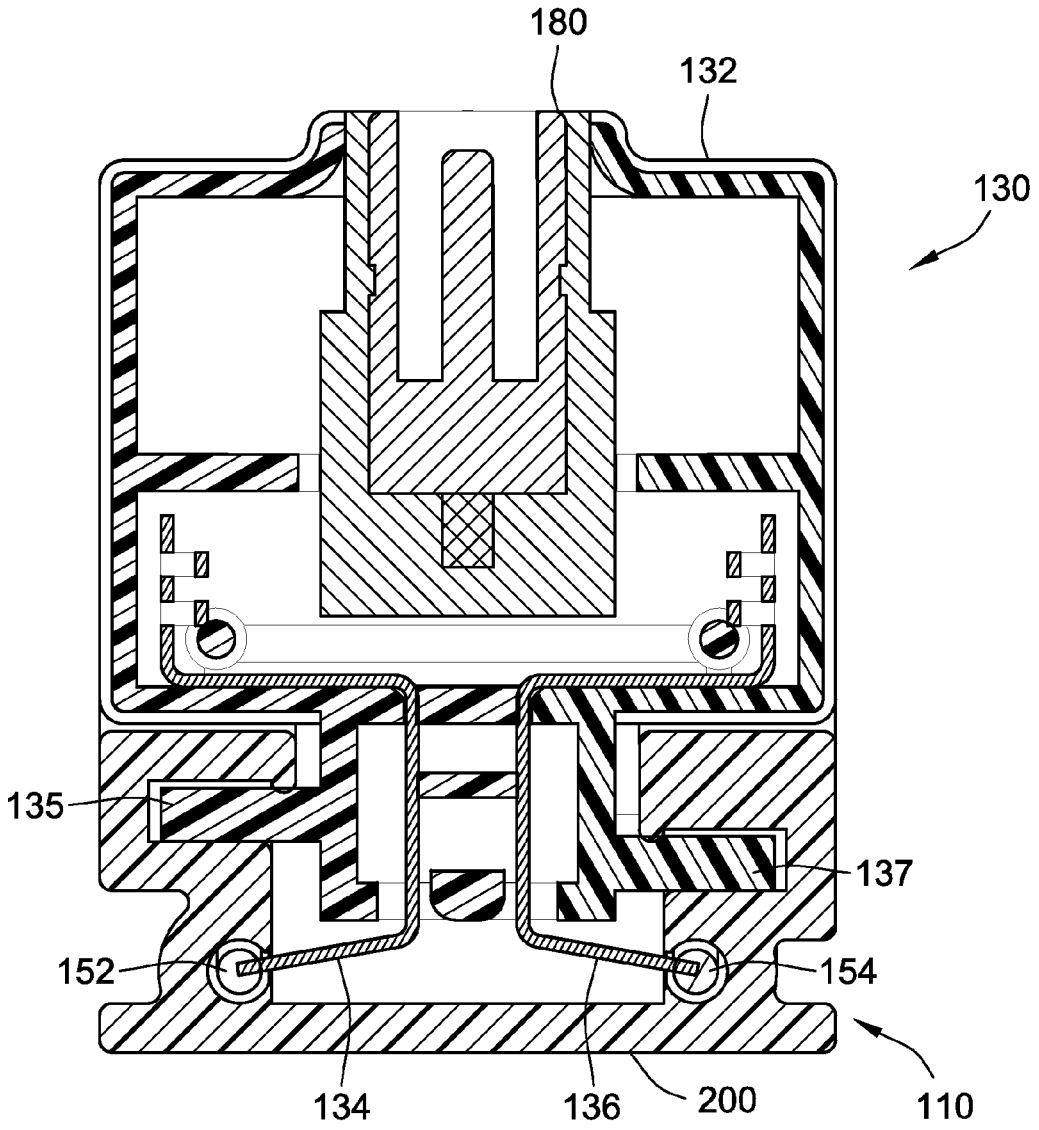
FIG. 13 illustrates a cross-section side-view of the take-away adaptor inserted into the track.

As FIG. 11-13 illustrates when the take-away adaptor 130 is inserted into the track 110 the first and second blades 135, 137 cooperate with the first and second rails 232, 234 in such a manner that the take-away adaptor 130 is only capable of rotating in one direction about its center axis. Although, FIG. 11-13 demonstrate an adaptor rotating in a particular direction about its axis those of skill in the art will understand that the adaptor may easily be modified to form the correct electrical and mechanical contacts when rotated in any direction. With specific reference to FIG. 11, the take-away adaptor 130 is first oriented as shown relative to the track 110. Turning now to FIG. 12, the take-away adaptor 130 is then inserted into the track 110 as shown. Thereafter, the take-away adaptor 130 is rotated as shown to achieve the orientation shown in FIG. 13.

Figure 17:
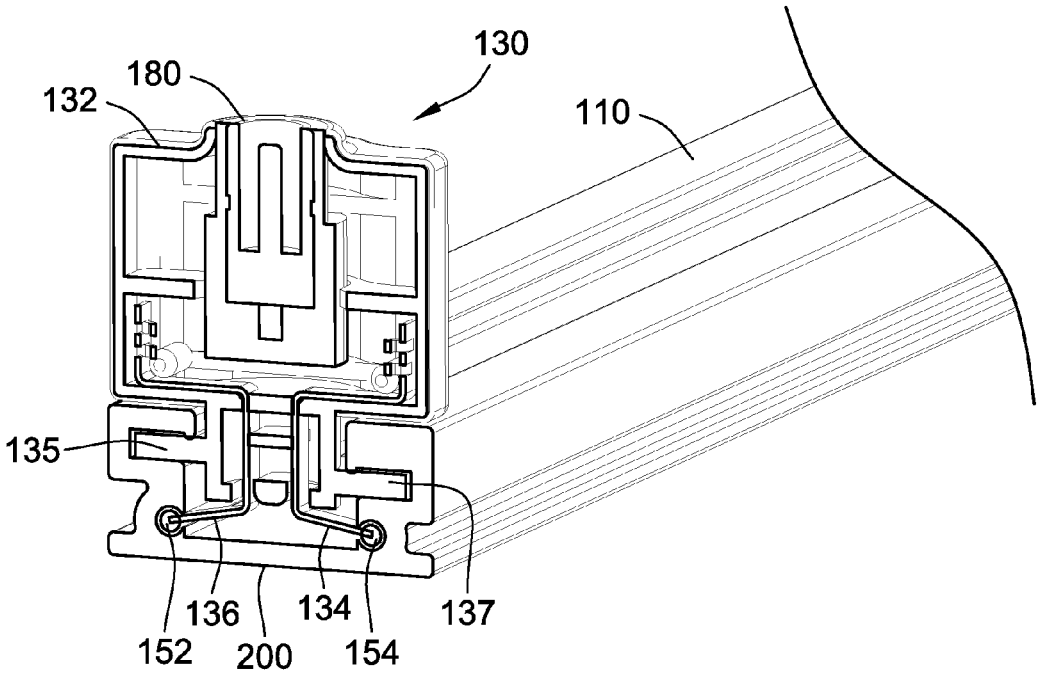
FIG. 17 illustrates an exemplary cross-sectional view of the take-away adaptor forming a mechanical and electrical connection with the track.
Figure 20:
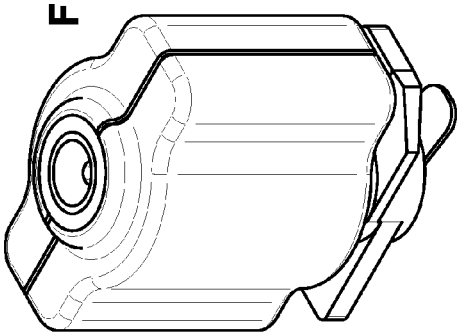
Figure 19:
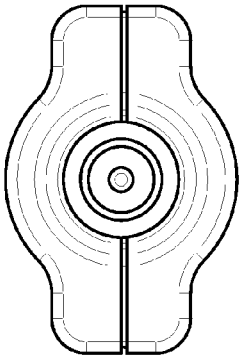
Figure 18:
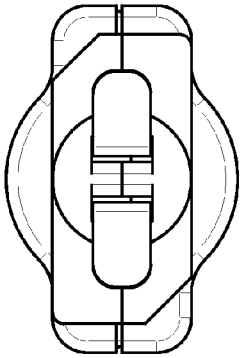
Figure 24:
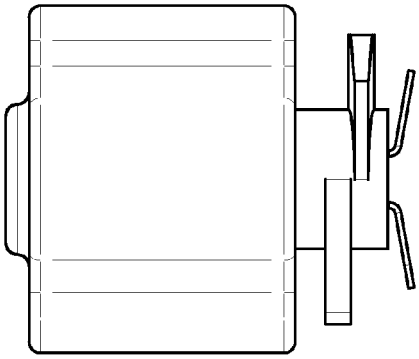
Figure 23:
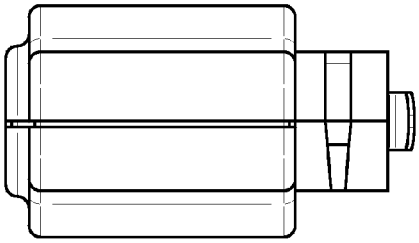
Figure 22:
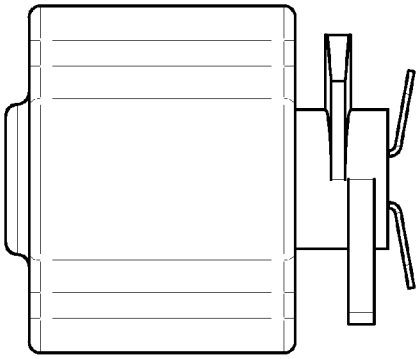
Figure 21:
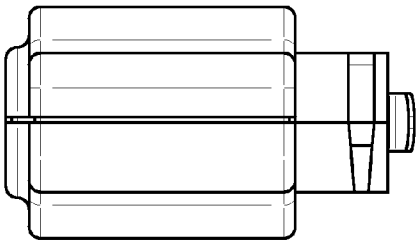

Referring momentarily back to FIGS. 7-9, each of the blades 135, 137 includes a top surface with an upper most flat portion 140 and a ramped portion 142 leading at an incline to flat portion 140. As the take-away adaptor 130 is rotated as shown in FIG. 12, each ramped portion 142 will respectively encounter the rails 232, 234. As the take-away adaptor 130 continues to rotate, the engagement of the ramped portions 142 and the rails 232, 234 will continue until the flat portions 140 engage the rails 232, 234. At this point, take-away adaptor 130 is then fully seated as shown in FIG. 13, as well as FIG. 17.

Returning to FIG. 11, the first and second grooves 22 and 24 of the track 110 have a corresponding contact slit 212 and 214. The first and second contact slits 212, 214 provide a means for the terminal end of the first and second stab 134, 136 of the take-away adaptor 130 to engage the first and second electrical conductors 152 and 154. Generally, the first and second contact slits 212 and 214 are large enough to allow the first and second stabs 134 and 136 to contact the corresponding electrical conductors 152 and 154 and small enough to prevent any possible shifting of the electrical conductors into the channel-shaped track 110. This feature allows the terminal contacts 138 and 139 of the adaptor 130 to tap into the electrical power supply provided by the bus bar assembly while not having the electrified bus bars 152 and 154 exposed.

Figure 14:
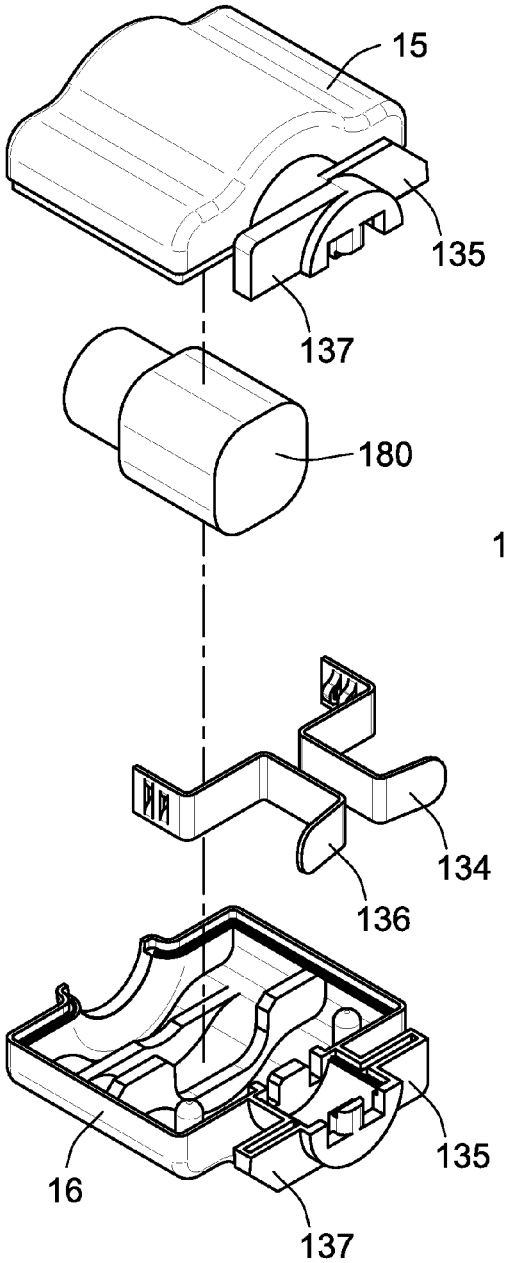
FIGS. 14-15 illustrate exploded views of the take-away adaptor.
Figure 15:
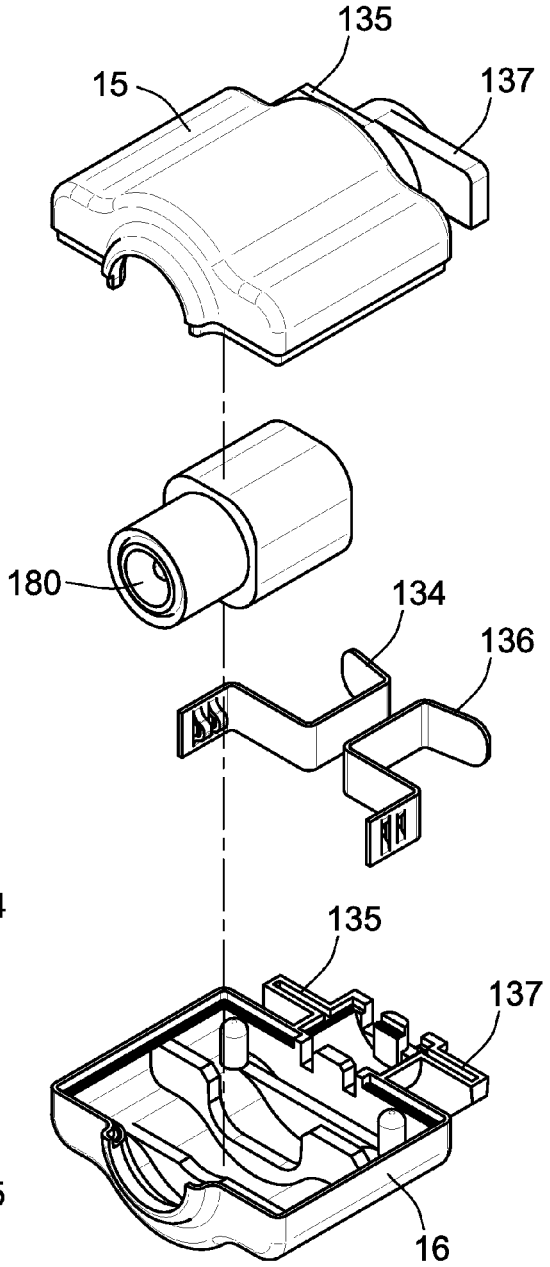

Turning now to FIGS. 14-15, the same illustrate an exploded view of the take-away adaptor 130. As shown therein, the take-away adaptor includes a two part housing formed by two shell members 15, 16. The first and second stabs 134, 136 and jack 180 are carried within the interior formed between the two shell members 15, 16 in their assembled state. The first and second stabs 134, 136 are electrically coupled to jack 180.

Figure 16:
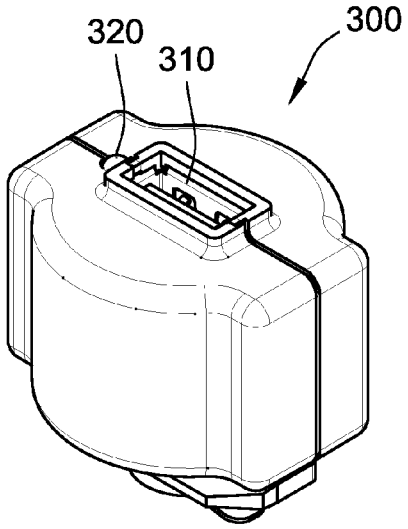
FIG. 16 illustrates a perspective view of an alternative embodiment of a take-away adaptor having a USB port as a jack.

FIG. 16 illustrates an alternative embodiment of the take-away adaptor 300 which includes a USB port 310 instead of a DC jack 180. The USB port 310 is coupled to first and second stabs 134, 136 in a similar manner as described above. Additionally, this embodiment also utilizes a light 320 to provide an indication that the take-away adaptor 310 is receiving power from track 110. It will be recognized that a light may also be incorporated into the embodiment of the take-away adaptor 130 shown in FIGS. 7-9.

FIGS. 18-31 show various additional views of take-away adaptors 130, 310 to expose surface contours thereof.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A bus bar assembly comprising:

an elongated track having a generally horizontal base, the track has at least a first and a second groove to receive and retain a first and a second electrical conductor of the track and configured for connecting to a power source; and wherein the bus bar assembly further comprises at least one removable take-away adaptor;

wherein the take-away adaptor includes at least a first and second electrically conductive contact elements capable of forming an electrical contact with the first and second electrical conductor to provide power and/or signal to an electrical device;

wherein the take away adaptor further comprises a first and second blade, wherein the first blade has an upper most edge, and the second blade has an upper most edge, the upper most edge of the first blade being situated in a first horizontal plane relative to the generally horizontal base of the track, the upper most edge of the second blade being situated in a second horizontal plane parallel to and vertically spaced apart from the first horizontal plane.

2. The bus bar assembly according to claim 1, wherein the generally horizontal base of the track is adapted to be mounted or connected to any flat surface.

3. The bus bar assembly of claim 2, wherein the track has a first and second J-shaped flange extending upwardly from the opposite ends of said horizontal base, the first and second J-shaped flanges having upwardly extending legs from which substantially horizontal arms extend inwardly towards each other in an opposed relation.

4. The bus bar assembly according to claim 1, wherein, the track is composed of a thermoplastic.

5. The bus bar assembly according to claim 4, wherein, the track is composed of Acrylonitrile butadiene styrene.

6. The bus bar assembly according to claim 1, wherein the take-away adaptor further comprises at least one jack;

wherein said jack is coupleable to at least one electrical signal connector to provide electrical power to the electrical device; or said jack is coupleable to at least one electrical signal connector to provide a signal to the electrical device.

7. The bus bar assembly according to claim 6, wherein the jack is one of a USB port or an electrical DC port.

8. The bus bar assembly according to claim 1, wherein the first and second electrically conductive contact elements provide an electrically conductive contact with a mating surface of the first and second electrical conductors, and the first and second blades couple with first and second rails of the track in an installed position of the take-away adaptor.

9. The bus bar assembly according to claim 1, wherein the track includes first and second rails configured for contact with the first and second blades of the take-away adaptor in an installed position of the take-away adaptor.

10. A retail display system comprising:

a retail merchandise display; and the bus bar assembly of claim 1, wherein the bus bar assembly is removabley mounted on or adjacent to the retail merchandise display.

11. The retail display system of claim 10, wherein the track is mounted to the retail merchandise display.

12. The retail display system of claim 10, wherein the track is aligned vertically along the retail merchandise display.

13. The retail display system of claim 10, wherein the track is aligned horizontally along the retail merchandise display.

14. The retail display system of claim 10, wherein the display element is an LED lighting system configured for the retail merchandise display.

15. The retail display system of claim 10, wherein there is more than one bus bar assembly having one or more take-away adaptors.

16. The retail display system of claim 10, wherein the first and second blades are adapted for mounting said take away adaptor to said track.

17. The retail assembly of claim 10, wherein the track is channel-shaped in cross-section and comprises a plurality of walls.

* * * * *